US006848807B2

(12) United States Patent
Guerrieri

(10) Patent No.: US 6,848,807 B2
(45) Date of Patent: Feb. 1, 2005

(54) PORTABLE LIGHT SOURCE AND RETAINER FOR MOUNTING

(75) Inventor: Salvatore Guerrieri, New York, NY (US)

(73) Assignee: Acolyte Technologies, LLC., New York, NY (US)

( * ) Notice: Subject to any disclaimer, the term of this patent is extended or adjusted under 35 U.S.C. 154(b) by 173 days.

(21) Appl. No.: 10/280,982

(22) Filed: Oct. 25, 2002

(65) Prior Publication Data

US 2003/0090895 A1 May 15, 2003

Related U.S. Application Data

(63) Continuation-in-part of application No. 09/750,879, filed on Dec. 28, 2000.

(51) Int. Cl.[7] ..... F21L 14/02

(52) U.S. Cl. ..... 362/155; 362/156; 362/802; 362/286

(58) Field of Search ..... 362/154–156, 362/802, 285, 286

(56) References Cited

U.S. PATENT DOCUMENTS 3,239,658 A * 3/1966 Castaldo ..... 362/155
3,800,134 A * 3/1974 Castaldo ..... 362/155
5,746,499 A * 5/1998 Ratcliffe et al. ..... 362/103
6,120,162 A * 9/2000 Guerrieri ..... 362/155
6,158,872 A * 12/2000 Rodgers ..... 362/156
6,582,093 B1 * 6/2003 Branaugh et al. ..... 352/156

* cited by examiner

*Primary Examiner*—Laura K. Tso
(74) *Attorney, Agent, or Firm*—Abelman, Frayne & Schwab

(57) ABSTRACT

A compact, battery-powered LED lighting device having manual and/or magnetically actuatable switches, a microprocessor and timer is used in a retaining system that includes a first retaining pouch for receiving the lighting device and a second retaining pouch for holding a magnet, the retainers being secured to opposing sidewalls of a container, such as a ladies handbag or a briefcase, so that when the container is opened a magnetic switch in the lighting device closes the circuit actuating the LED to illuminate the interior contents of the container for a predetermined period of time. The manual switch can be used to override the timed illumination and to turn the LED on or off at any time.

53 Claims, 5 Drawing Sheets

PORTABLE LIGHT SOURCE AND RETAINER FOR MOUNTING

This application is a continuation-in-part of co-pending application Ser. No. 09/750,879 filed on Dec. 28, 2000.

FIELD OF THE INVENTION

The invention relates to manual and magnetically-actuated light sources that are mountable in the interior of manually-portable carrying cases, such as, ladies' handbags, purses, knapsacks, briefcases, article of luggage, and the like.

BACKGROUND OF THE INVENTION

This invention is an improvement on the magnetically-actuated light source disclosed in my U.S. Pat. No. 6,120,162. The entire disclosure of U.S. Pat. No. 6,120,162 is incorporated herein by reference. That patent discloses a lighting system that included two separate light sources joined by conductors to a switch and to a separate battery. A magnetically-actuated reed switch responds to the magnetic field provided by a magnet that is brought into a position proximate the switch. In one of the embodiments disclosed in that patent, a magnet is secured to the flap of a ladies handbag or purse and is positioned in close proximity to the reed switch when the flap is closed, the reed switch then being in a position that interrupts the flow of current to the light sources positioned on the interior of the handbag. When the flap is opened and the magnetic field is moved away from the reed switch, the circuit is closed, thereby allowing current to flow to the light sources which illuminate the contents located in the interior of the handbag.

The system disclosed in U.S. Pat. No. 6,120,162 has certain drawbacks from the standpoint of assembling the handbag and maintaining the wire conductors in a stable position and one that assures a secure connection to the respective terminals of the switch, battery and light source.

It is therefore a principal object of the invention to provide a small and compact, reliable modular light source in which the battery power supply, switch, lighting element and any associated control circuit is self-contained in a unit without external wires, terminals and the like, which lighting device can be securely, but removably positioned to illuminate the interior of a ladies handbag, purse, a mens travel kit and the like.

Another object of the invention is to provide an improved apparatus and method for retaining the elements of a magnetically or manually-actuated light source in a secure position in the interior of a lady's handbag or other manually-portable personal effects carrying container.

It is a further object of the invention to provide a light-weight and inexpensive mounting system for securing the elements of a magnetically-actuated light source that can be easily assembled, either permanently or removably to a lady's handbag, purse, or the like.

It is yet another object of the invention to provide a mounting system and method for a manually and/or magnetically-actuated light source that will assure the retention of the light source in a predetermined desired position to maximize the effectiveness of the illumination of the contents of the handbag, purse or other container.

SUMMARY OF THE INVENTION

The above objects and other advantages are achieved by the present invention in which a small compact and unitary light source or lighting device having at least one light-emitting diode ("LED") is provided with a manual and magnetically-actuated power switch and an automatic timer to turn off the light after a predetermined period of time. In a preferred embodiment, a programmable microprocessor is also included in the circuit to provide additional optional features and functions. A power source, preferably disk-shaped long-life batteries, are included in a shock and impact resistant housing with all of the other components and connecting circuitry. In one preferred embodiment, a removable battery cover allows the one or more batteries to be replaced as needed.

The lighting device of the invention is mounted in a first retainer and a magnet is mounted in a second retainer, at least one sidewall of each retainer permitting the magnetic field of the magnet to come into operational proximity to the magnetically responsive switch on the light source. The retainer for the lighting device also permits the manual switch to be pressed by the user's thumb or finger to actuate the light and timing circuit device.

The invention broadly comprehends a system for retaining the elements of a magnetically-actuated self-contained light source for a manually-portable container, where the light source includes a housing, a magnetically actuatable switch inside the housing and at lease one LED projecting from a wall of the housing, the retaining system comprising:

a first retainer defining an interior volume for receiving the light source in close-fitting relation, a first marginal portion of the first retainer having a number of openings corresponding to the number of LEDs, each opening communicating with the interior volume for receiving a projecting LED, whereby the at least one LED extends beyond the retainer; and a second retainer defining an interior volume for receiving a magnet in close-fitting relation, the first and second retainers each having at least one side wall that is configured to bring the magnet within operable proximity to the light source housing, whereby the position of the magnetically-actuatable switch is changed.

In a preferred embodiment, both the first and second retainers take the form of thin-walled supporting pouches that receive and retain the light source and magnet in a close-fitting relation. The first retainer pouch is provided with one or a plurality of marginal apertures corresponding to the number of LED light sources. The light source pouch can be fabricated from a polymeric sheet or web, or from textile, leather or other suitable material. The LED generates essentially no heat and presents no bum hazard to the user's skin or the material of the retainer or contents of the container in which it is placed.

The light source pouch is preferably provided with a flap or similar opening to permit the lighting device to be removed, e.g., for replacement of its battery or of the entire unit. When closed, the flap securely retains the light source housing and maintains the one or more LEDs in their respective positions extending through a corresponding number of the marginal apertures.

The light source pouch is also provided with a portion that can be sewn or otherwise permanently secured or temporarily affixed to the handbag or other container in which it is to be utilized.

In one preferred embodiment, the first retainer is in the form of a slip pocket, the opening of which pocket faces the interior sidewall of the container and the portion of the pouch above the pocket is sewn into the lining of the container, e.g., handbag.

A pouch constructed of similar material and optionally including a flap, receives a magnet in close-fitting relation. The magnet pouch is configured for attachment to an opposing wall of a lady's handbag or other container so that when the opposing portions of the container are brought together to close its opening, the magnetic field produced by the magnet is in sufficiently close proximity to actuate the current-controlling reed switch in the circuit contained in the light source housing to change the position of the switch and thereby open the circuit and interrupt the current flow to the one or more LEDs. In one preferred embodiment of the invention, the magnet is permanently sealed in its pouch, since there is no requirement for maintenance as with the battery or the complete replacement of the light source. The second retainer pouch containing the magnet can also be sewn behind the lining of a handbag so that it is not visible or to the exposed surface of the lining, e.g., as a decorative element.

The respective magnet and light source housing pouches can be of the same material, which in one embodiment is a heat-sealable polymeric material such as, polyvinyl chloride and polyethylene. The polymeric material can be conveniently provided in the form of sheets or webs from which the material for the pouches are die-cut and then folded and heat sealed along their margins in accordance with methods and apparatus well known in the art.

In another preferred embodiment, the pouch is a natural product, such as leather or textile material that is sewn into the appropriate configurations to retain the light source and the magnet. The fabric or leather is provided with one or more metal or plastic eyelets around the LED orifice. The fabric can be printed and the leather embossed or otherwise treated to display a logo, trademark or other ornamentation that compliments the design of the handbag or other container.

As noted above, in one preferred embodiment, the magnet is permanently sealed in its pouch; one or more additional seams can be provided using a heated wheel, die, radio frequency welding or the like, to provide a separate internal pocket to prevent movement of the magnet.

Both pouches are provided with an attachment portion, preferably extending along one margin of the pouch, to permit its permanent or temporary attachment to the respective supporting walls of the handbag or other container. Depending upon the materials of construction of the handbag or other container into which the magnetically-actuated light source system is to be assembled, the attachment can be by stitching, by adhesive, or by crimping the attachment portion of the pouches into the metal frame of a handbag or other container.

In one preferred embodiment, the attachment portion of the respective pouches are provided with a coating of adhesive that retains its tackiness and that is covered with a release paper. In this embodiment, the pouches can be sold to consumers for their own assembly into existing handbags, tote bags and the like. instruction can be provided to assure proper alignment of the pouches.

In other preferred embodiments, the pouch or pouches can be attached by clips, by hook and loop fastener elements, by snaps and by pins. The fastener systems contemplate the removal and transfer of the pouches to other articles.

It has been found that a single LED of the super-bright to ultra-bright types provides sufficient to illuminate the interior of even a large lady's handbag. Other suitable equivalent sources of illumination can be substituted.

The preferred power source is a lithium battery having an extended life. A three-volt alkaline or lithium coin cell or watch style battery is preferred. The voltage can range from 1.2 to 6.0 volts. Suitable batteries also include 1.5-volt AA, AAA and 9-volt batteries.

As will be understood by one of ordinary skill in the art, a larger container, such as a briefcase or piece of luggage may make it desirable to utilize two or more LEDs extending from a single lighting device, in which case more than one battery can be advantageously utilized to insure sufficient power and a reasonable life before battery replacement.

In accordance with the method and apparatus disclosed in my earlier patent, the lighting device circuitry also includes an automatic shut-off switch that is actuated by a timer. This feature avoids the possibility that the battery power will be needlessly depleted should the user fail to close the handbag. An appropriate timer is the industry standard known as the "555", which can be programmed for any predetermined desired time for providing illumination to the interior of the case. The timer can also take the form of a voice chip that can be programmed to open the light circuit after a predetermined period of time. A custom designed IC device can also be utilized.

A period of twenty to thirty seconds or up to 90 seconds of illumination is typically sufficient for a lady's cosmetic case or handbag; a period of two minutes of illumination can be provided for a briefcase or the like. The lighting device can also be provided with a manual switch that will reactivate the timer in the event that the initial time proves to be insufficient for the user's purpose. The magnetic switch is actuated from what would nominally be deemed to be an open or a closed position.

In a further preferred embodiment, the retainer pouch containing the light source and having a manually activated switch is sold separately for assembly to a handbag or other carrying case without the magnet. In this embodiment, the user manually actuates the LED by pressing a manual push-button switch, thereby initiating the timer. In this embodiment, it will be understood that the pouch containing the light source can be used without regard to placement on a sidewall that must be brought into a position proximate the magnet in the second retainer pouch when the handbag or other container is closed.

It will be understood from the above, that the invention also comprehends a mounting retainer for a light source, the light source including a housing, an LED extending from an edge of the housing and a manually actuatable switch on a surface of the housing for turning the LED on and off, the retainer comprising:

opposing sidewalls, joined at their edges and forming a pocket having an interior volume for receiving the light source in close-fitting relation;

an orifice extending through at least a portion of one sidewall for receiving the LED in close-fitting relation;

a mounting portion contiguous with at least a portion of one sidewall for receiving mounting means; and mounting means for securing the retainer to an interior portion of an article requiring illumination by the light source.

BRIEF DESCRIPTION OF THE DRAWINGS

The invention will be described in further detail below and with reference to the attached drawing sheets in which.

DETAILED DESCRIPTION OF THE PREFERRED EMBODIMENTS

Figure 1:
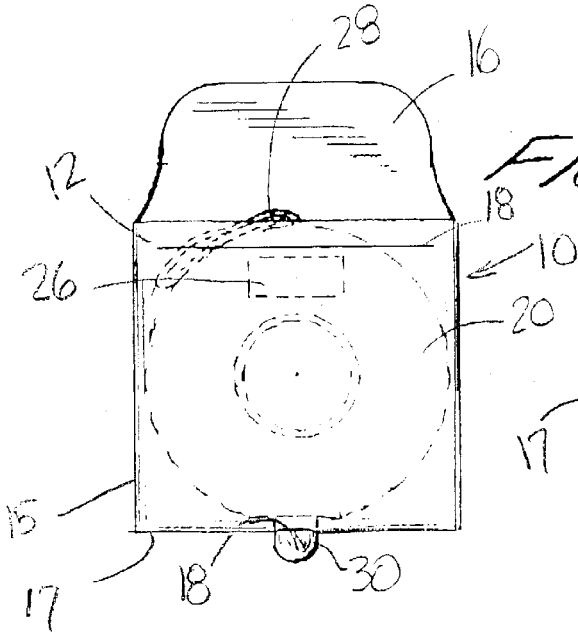
FIG. 1 is a plan view of one embodiment of an open retainer pouch made of flexible material containing a lighting device in accordance with the invention.
Figure 2:
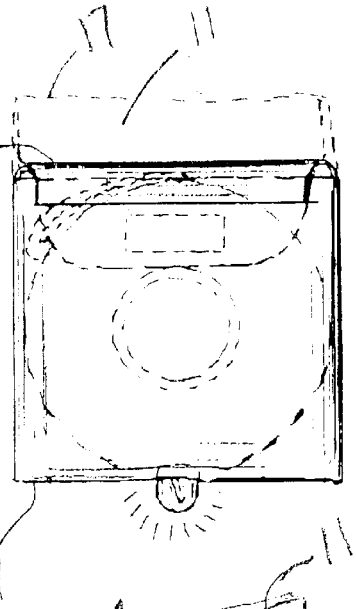
FIG. 2 is a view similar to FIG. 2 with the flap of the pouch in the closed position.

Referring now to the figures in greater detail, where like reference numerals note similar elements, there is shown in FIG. 1 a first retainer 10 in the form of a pouch formed of a flexible and heat-sealable polymeric material 12 that is folded transversely at line 17 and heat-sealed along its marginal edges 15 to form a pocket closed by flap 16. A transverse slit 18 extends across the face opposite flap 16 and, as best shown in FIG. 2, is dimensioned to receive the free end of the flap when the pouch 10 is in the closed position.

The end of the pouch opposite the flap includes an orifice 18 that is dimensioned to receive the cylindrical shaft of an LED. As also shown in phantom in FIG. 2, the first retainer can also be provided with a mounting portion 11 that is formed by heat-sealing an extension of polymeric web 12 in superposed position. Mounting portion 11 provides a reinforced panel in this embodiment that can be stitched, crimped, riveted, or otherwise secured to the handbag or other container. The mounting panel, which is of a double thickness, can be cut or otherwise contoured to receive a clip or other fastener which will permit easy attachment and removal to the strap of a handbag, article or clothing, or the like. If a clip or ring is to be joined to the mounting portion 11, one or more attaching holes or slots can be provided with reinforcement by heat-sealing means well known in the art. Further reinforcement can be provided by incorporating a plastic or metal grommet during the heat-sealing operation.

It will also be understood that the first retainer as illustrated in FIG. 1 can be sewn or otherwise secured to the interior of the handbag or other container without utilizing the foldable flap 16. In this method of assembly, the portion identified as flap 16 serves as the mounting portion 11, as described above. In this manner of use it is preferable to have the open pocket of the pouch 10 face inwardly towards the interior sidewall of the handbag or container in order to minimize the possibility that the lighting device 20 will be displaced from its close-fitting position inside the pocket.

Figure 3:
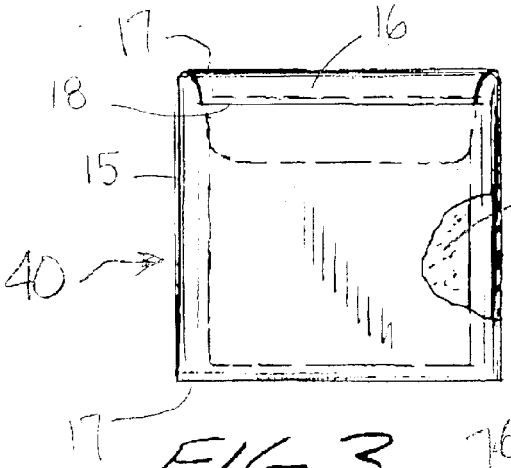
FIG. 3 is a plan view of one embodiment of a closed retainer pouch containing a magnet.

With reference to FIG. 3, a second retainer 40 with magnet 50 positioned inside is constructed of materials and in a manner similar to that described in connection with FIGS. 1 and 2. Since magnet 50 requires no maintenance or replacement, the second retainer 40 can be formed by folding and heat-sealing a web or strip of material that also includes an optional mounting portion 11 (not shown). As will be described in more detail below, particularly with reference to FIGS. 12–16, the first and second retainer pouches 10 and 40 are mounted on opposing portions of the container so that they are in close proximity when the container is closed, thereby assuring that the magnetic field emanating from magnet 50 operably positions the magnetically-actuatable switch to turn off the power to the LEDs.

An alternative embodiment to the soft-sided first retainer is formed as a thin-walled molded retainer 70 having a receiving portion 72 to accept the lighting device 20 that is integrally molded with closure 74 along living hinge 76. An orifice 78 is provided in bottom wall 79 for receiving the shaft of the LED.

Figure 4:
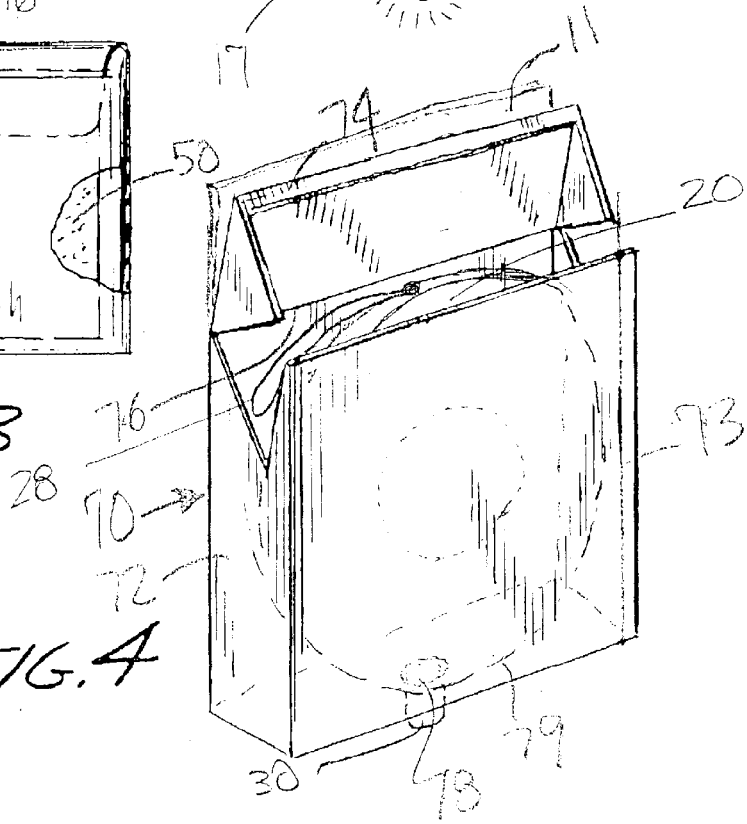
FIG. 4 is a front left side perspective view of a molded retainer containing a lighting device in accordance with another embodiment of the invention.

In the embodiment of FIG. 4, the sidewall 73 is sufficiently flexible to permit the manual switch of lighting device 20 to be actuated by pressure applied to the sidewall. The molded first retainer can also be provided with an integral mounting portion 11 that extends across all or a portion of the rear wall of the receiving portion 72. In this embodiment, the mounting portion 11 can be thin to receive stitching and/or deformable for mounting in a handbag with a metal frame or the like.

Referring now to FIGS. 5 through 8, there is shown one embodiment of an improved lighting device 20 of the present invention. Housing elements 21 contain the necessary electrical conductors, manual switch, timer and any other desired integrated circuit devices required in the activation and use of the light source. As shown in this embodiment, a single LED 30 projects through opening 18 formed in mated housing elements 21. The housing can be molded or machined from any of a wide variety of rigid or pliable polymeric materials or metals. It can assume any convenient and/or ornamental appearance that will accommodate the required electrical elements and functions. In the particular embodiment illustrated in FIGS. 5–8 and the separate embodiment of FIG. 9, the lighting device 10 has a generally circular cross-section and arcuate upper and lower major surfaces. The LED 30 projects through the housing along the circumferential edge.

Figure 7:
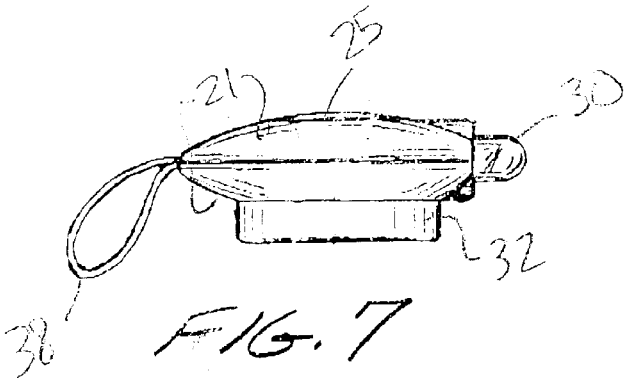
FIG. 7 is a side elevation of the lighting device of FIG. 5.
Figure 8:
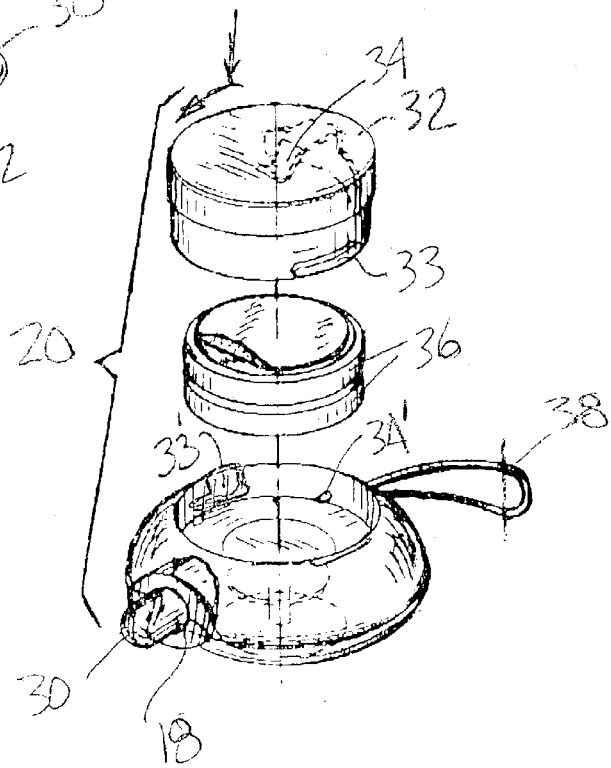
FIG. 8 is an exploded view of the lighting device of FIG. 5 illustrating placement of the battery power source.

Referring to FIGS. 7 and 8, replaceable batteries 36 are contained in and made accessible by way of removable battery cover 32 that is provided with releasable locking rings 33 that engage one or more locking pins 33 in a sidewall of the recess formed in upper housing element 21. Battery cap 32 also includes a metallic conductor element 34 that extends from a central portion of the interior of the battery cover and extends down the interior sidewall. When the cap is lowered into position over the batteries 36 and turned to engage locking element 33 in groove 33' the lower portion of conductor 34 contacts conductive circuit pin 34' located along the interior wall of the battery recess. The locking elements 33 and 33' are dimensioned so that the battery cover can be securely retained in a first position in which the conductive element 34 and contact pin 34' are not engaged. When the battery cover is turned to its fully locked position, the electrical contact is completed. In a particularly preferred embodiment the start-up function of the IC device is programmed to cause the LED to rapidly flash a predetermined number of times to alert the user that the batteries are now in the circuit. This arrangement provides the advantage of allowing the batteries to be installed beneath the cover at the factory or other point of assembly, but without having the batteries in the circuit. It also permits the user to turn the battery cover a few degrees from the fully locked engaged position to take the batteries out of the circuit in order to prevent the LED from functioning.

The lighting device is also provided with an optional lanyard 38 that can be of an elastic material.

Figure 5:
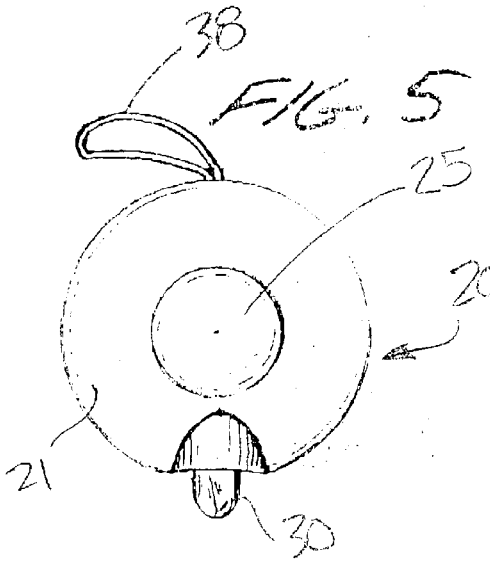
FIG. 5 is a top plan view of one embodiment of a lighting device in accordance with the invention.
Figure 6:
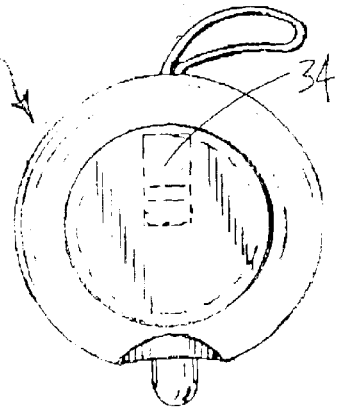
FIG. 6 is a bottom view of the lighting device of FIG. 5.

With further reference to FIG. 5, upper housing element 21 is provided with a central aperture through which projects a push-button 25. Positioned beneath push-button 25 is a pressure actuated manual switch that will turn the light on and off when moved from one position to another. The manual switch can be utilized to turn the light on after the timer has turned the LED off.

Figure 9:
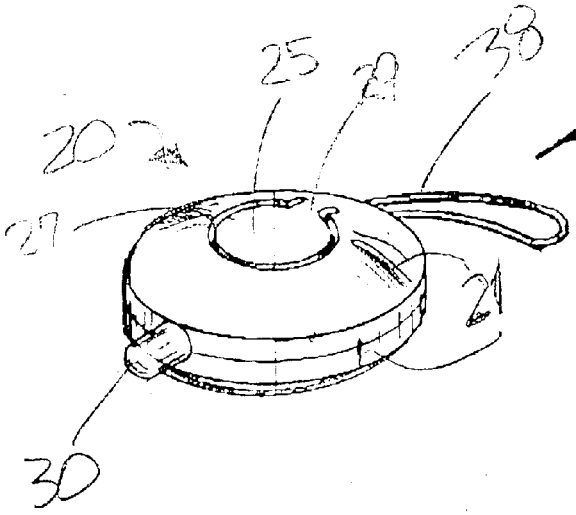
FIG. 9 is a top right front perspective view of a lighting device in accordance with another preferred embodiment of the invention.

In the alternative embodiment of FIG. 9, the housing elements 21 are permanently sealed or joined together after the battery is installed during manufacture. The push-button 25 is integrally formed in the upper housing element by a narrow opening 27 which defines the periphery of the push-button 25 and extends around all but a small portion of its periphery leaving a bridge 29 that forms a living hinge.

Figure 10:
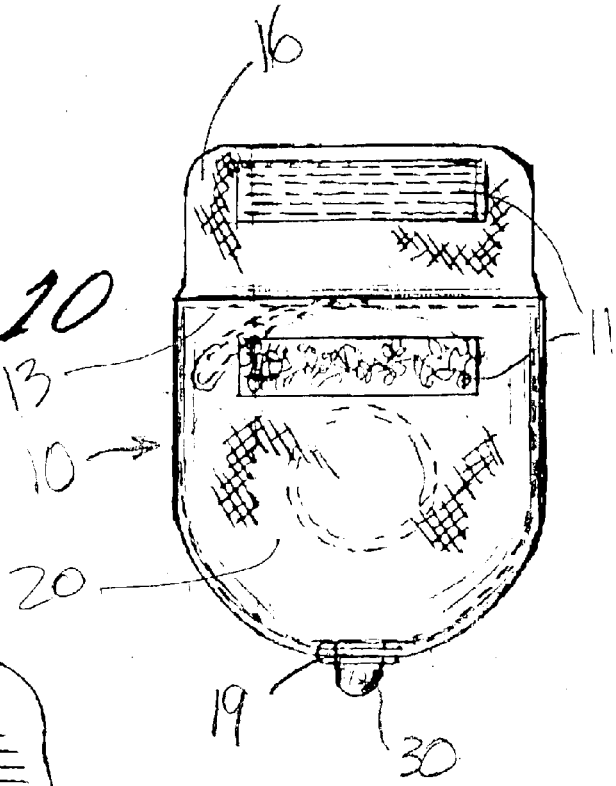
FIG. 10 is a plan view of an open retainer in accordance with a further preferred embodiment of the invention.
Figure 11:
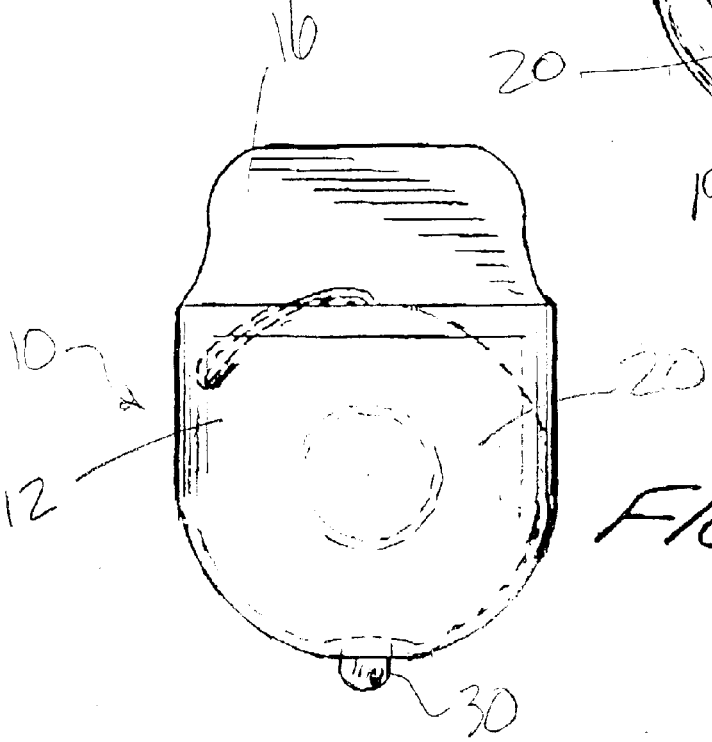
FIG. 11 is a plan view of another open retainer in accordance with yet a further preferred embodiment of the invention.

FIGS. 10 and 11 show further alternative embodiments of first retainers 10. In both of these embodiments, the lower portion of the retainer assumes the contour of lighting device 20, which in this instance is semi-circular.

In the embodiment illustrated in FIG. 10, the pouch 10 is fabricated from leather or textile and a decorative metal grommet 19 is fitted around the opening that surrounds LED 30. Flap 16 and a corresponding portion of the front wall are provided with strips of hook and loop fastener material. The fabric is sewn to close the edges of the pouch.

FIG. 10 is a construction similar to that of FIGS. 1 and 2, and illustrates the heat sealing of the lower contoured periphery of the first retainer pouch 10.

Figure 12:
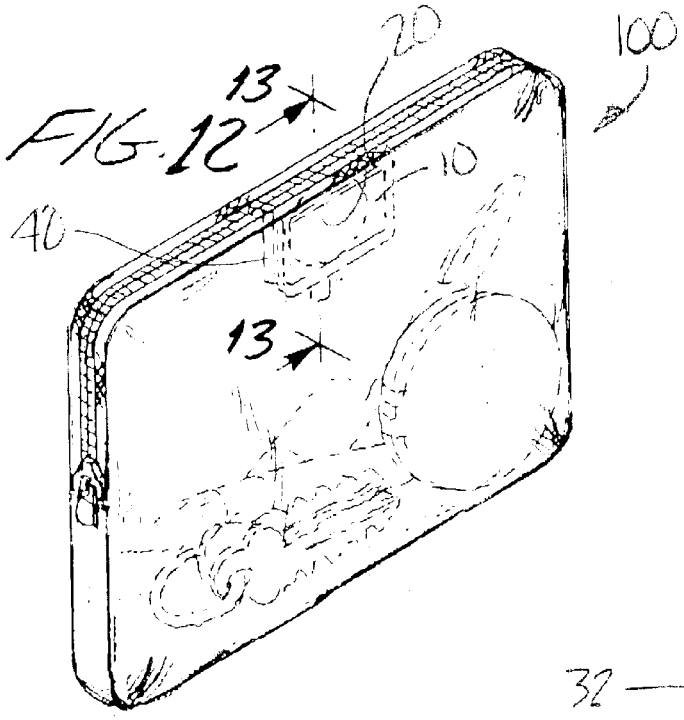
FIG. 12 is a front left perspective view of a zippered container that is assembled with the system of the present invention.
Figure 13:
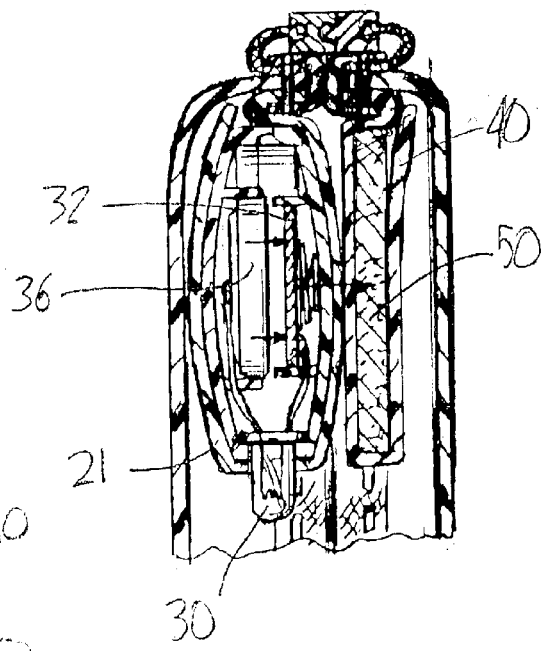
FIG. 13 is a view of the container of FIG. 12 taken along line 13—13.

Referring now to FIG. 12, there is shown a cosmetic case or zippered purse 100 in which retainer 10 and second retainer 40 in the form of plastic pouches have been assembled. The first retainer 10 contains lighting device 20 having a single LED 30 projecting from its periphery, passing through an opening 18 in the lower margin of the pouch. A second magnet-retaining pouch 40 is assembled to the opposite sidewall of the case at a position that, as shown in FIG. 13, is predetermined to bring the magnet 50 into operational proximity so that its magnetic field will actuate the switch 32 in the light source housing 21 to interrupt the flow of current from the battery or batteries 34 to the LED.

Figure 14:
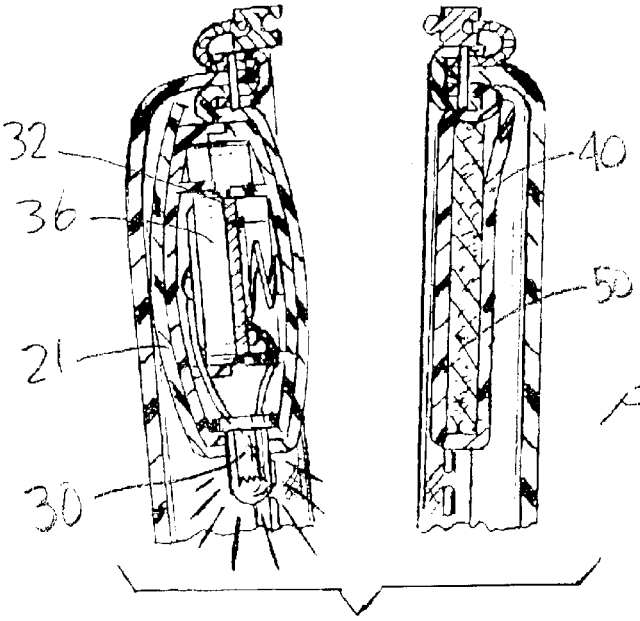
FIG. 14 is a view similar to FIG. 13 showing the zipper in the open position to separate the container sidewalls and the LED of the lighting device illuminated.

Referring to FIG. 14, the case 100 is shown in a partially opened position where the magnet 50 is sufficiently distant from switch 32 that its magnetic field is not able to retain the switch contact element in an off position and the circuit between the LED and battery is closed, thereby providing illumination to the interior of the case In this embodiment, the first and second retainers 10 and 40 are assembled to the container 100 by sewing. As will be understood by those of ordinary skill in the art, handbags, purses and other containers have hinged metal frames and the like that form the mouth of the opening. The metal frames include elements for crimping the leather or fabric exterior and/or lining material of the handbag during its assembly and one or both of the retainer pouches can include a mounting portion that is incorporated with the exterior and/or lining into the finished bag at the time of its manufacture.

Figure 15:
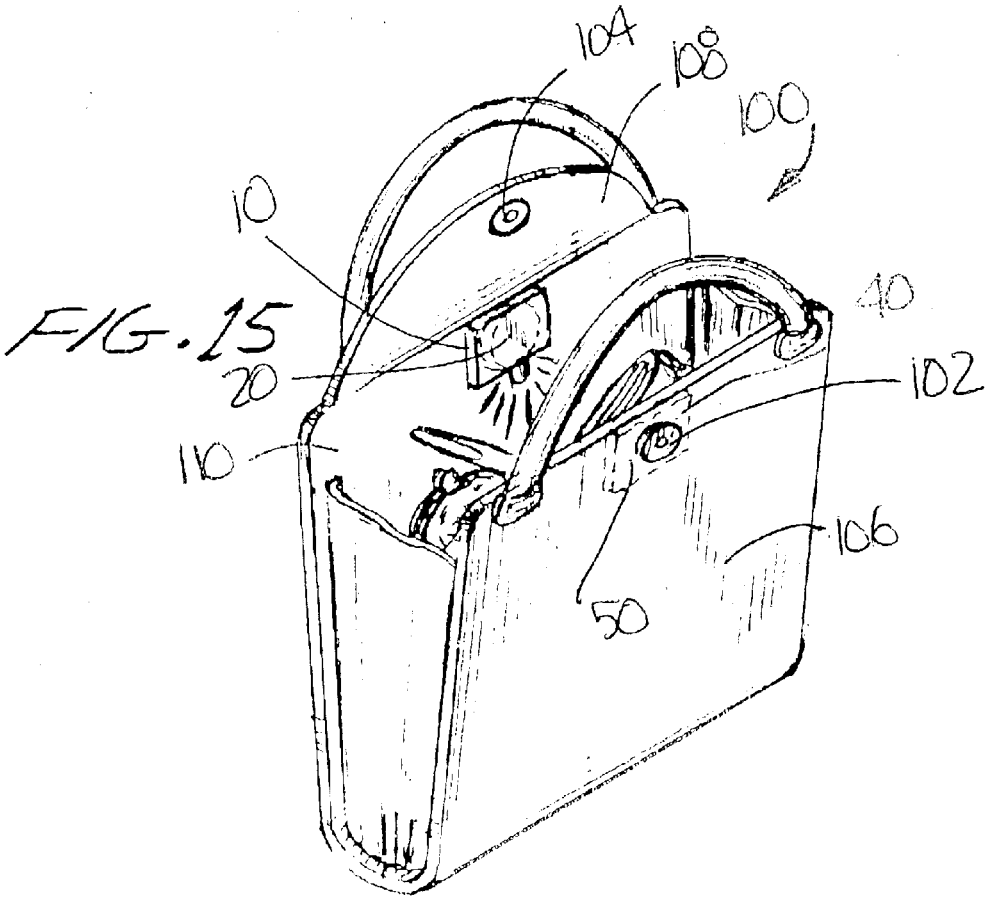
FIG. 15 is a front left perspective view of an open handbag that is provided with the system of the present invention.

Referring to FIG. 15, there is shown a lady's handbag 100 in the open position with the elements of a magnetic fastener assembly 102 attached to the exterior of a sidewall 106 and the mating fastener element attached to flap 108. In this embodiment of the invention, the magnetic fasteners 102 and 104 are well known in the art and in widespread use.

With continuing reference to FIG. 15, a lighting device 20 is mounted in retainer 10 on an interior sidewall 110 opposite wall 106. In this embodiment, the magnetic field produced by the fastener elements 102 and/or 104 is sufficient to change the position of the magnetically-actuatable switch in lighting device 20 when the flap is in the closed position and the fastener elements secured. Optionally, a second retainer 40 and magnet 50 can be mounted on the interior of sidewall 106 in alignment with the switch of lighting device 20 when the handbag is in the closed and secure position.

Figure 16:
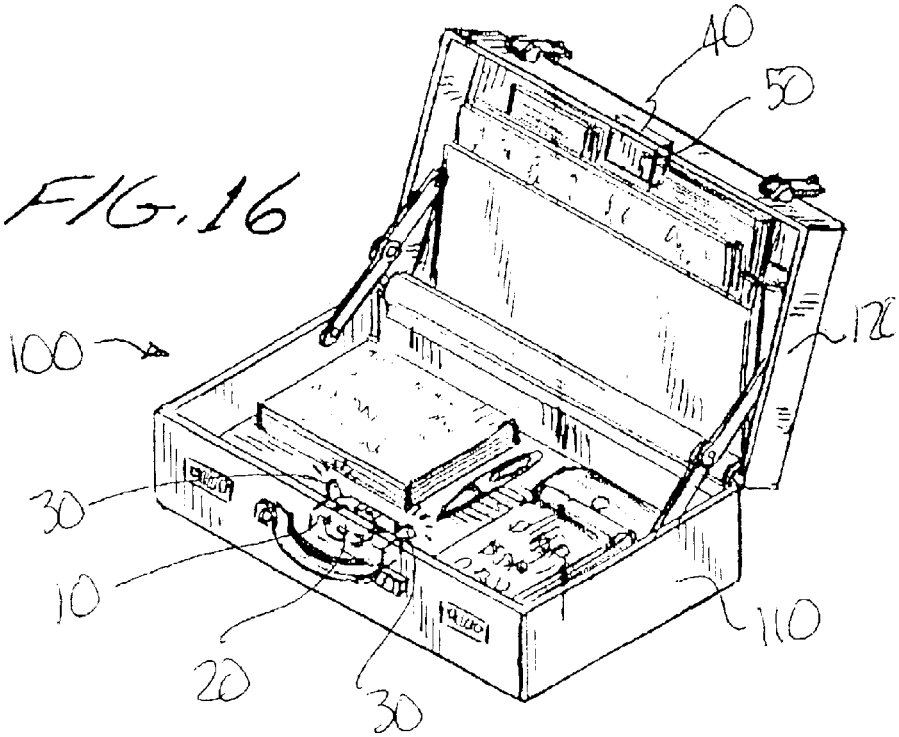
FIG. 16 is a top front perspective view of an open briefcase that is provided with the lighting system of the invention.

Referring now to FIG. 16, there is illustrated a briefcase 100 having a base 110 and hinged lid 120 that has been provided with an illuminating system of the present invention. In this embodiment, the first retainer 10 having a lighting device 20 with two LEDs in spaced relation is attached to the base 110 to illuminate the interior of the briefcase. The second retainer 40 with magnet 50 is mounted at a corresponding position on the top 120 so that the magnetic field emanating from magnet 50 will be proximate to the magnetically-actuatable switch in light source 20, thereby interrupting the current flow to the LEDs when the case is closed.

As will be understood by one of ordinary skill in the art, various modifications and changes to the specific configurations illustrated and the methods and materials of construction can be made without departing from the novel features of the disclosure as defined by the claims that follow.

I claim:

1. A system for retaining the elements of a magnetically-actuated self-contained light source for a manually-portable container, where the light source includes a housing, a magnetically actuatable switch inside the housing and at least one LED projecting from a wall of the housing, the retaining system comprising:

a first retainer defining an interior volume for receiving the light source in close-fitting relation, a first marginal portion of the first retainer having a number of openings corresponding to the number of LEDs, each opening communicating with the interior volume for receiving a projecting LED, whereby the at least one LED extends beyond the retainer; and a second retainer defining an interior volume for receiving a magnet in close-fitting relation, the first and second retainers each having at least one side wall that is configured to bring the magnet within operable proximity to the light source housing, whereby the position of the magnetically-actuatable switch is changed.

2. The system of claim 1, wherein the housing of the light source is generally circular in cross-section and the first retainer is rectilinear.

3. The system of claim 2, wherein the first retainer conforms closely to at least a portion of the exterior configuration of the housing.

4. The system of claim 1, wherein at least the first retainer includes a moveable portion having an open position to permit removal of the light source.

5. The system of claim 1, wherein the first and second retainers are formed from a flexible heat-sealable polymeric material.

6. The system of claim 4, wherein the moveable portion is a flexible flap.

7. The system of claim 4, wherein the second retainer includes at least one heat-bonded seam positioned internally of the retainer margins and proximate to the magnet, whereby the magnet is secured in a predetermined position.

8. The system of claim 1, wherein each of the first and second retainers include an attachment portion for securing the retainer to the interior of the container.

9. The system of claim 7, wherein the attachment portion of the first retainer is opposite the first marginal portion.

10. The system of claim 8, which further comprises a layer of adhesive on the attachment portion and a removable protective release covering on the surface of the adhesive opposite the attachment portion.

11. The system of claim 8, wherein the attachment portion forms a portion of a margin of the respective retainers.

12. The system of claim 11, wherein the marginal attachment portion is generally opposite the at least one LED opening in the first marginal portion.

13. The system of claim 1, wherein the first retainer has two LED openings at spaced-apart locations along an edge.

14. The system of claim 1, wherein the first retainer is fabricated from a material selected from the group consisting of textiles, natural and synthetic leathers and polymers.

15. The system of claim 1, wherein the at least one LED opening in the edge of the retainer is fitted with a reinforcing grommet.

16. The system of claim 1, wherein the first retainer is molded plastic.

17. The system of claim 16, wherein the molded retainer is thin-walled.

18. The system of claim 16, wherein the molded plastic retainer includes an integral closure joined to a lighting device receiving portion by a living hinge.

19. The system of claim 17, wherein the retainer includes an integrally molded mounting portion.

20. A mounting retainer for a light source, the light source including a housing, an LED extending from an edge of the housing and a manually actuatable switch on a surface of the housing for turning the LED on and off, the retainer comprising:

opposing sidewalls, joined at their edges and forming a pocket having an interior volume for receiving the light source in close-fitting relation;

an orifice extending through at least a portion of one sidewall for receiving the LED in close-fitting relation; and a mounting portion contiguous with at least a portion of one sidewall for receiving mounting means;

wherein the mounting means is selected from the group consisting of adhesive, hook and loop fasteners, releasable clips and magnets.

21. The retainer of claim 20 further comprising mounting means for securing the retainer to an interior portion of an article requiring illumination by the light source.

22. The retainer of claim 20, wherein a sidewall adjacent the switch on the light source is deformable, whereby the position of the light switch can be changed by pressure manually applied to the sidewall.

23. The retainer of claim 20, wherein the sidewalls are formed from a flexible material selected from the group of thermosetting and thermoplastic polymeric materials, textiles, natural and synthetic leathers.

24. The retainer of claim 23, wherein a pair of opposing sidewalls are joined along their edges by heat bonding.

25. The retainer of claim 24, wherein at least one edge is formed by a foldline.

26. The retainer of claim 25, wherein the LED-receiving orifice is formed along the foldline.

27. The retainer of claim 20 which further comprises a closure for securely retaining the light source in the interior of the retainer.

28. The retainer of claim 27, wherein the closure is joined to a sidewall along a flexible foldline.

29. The retainer of claim 23, wherein the sidewalls are a thermosetting polymeric material in the form of a deformable semi-rigid molded container.

30. The retainer of claim 29, wherein the closure is joined to a sidewall by a living hinge.

31. The retainer of claim 20, wherein the mounting portion extends away from the pocket.

32. The retainer of claim 20, wherein the mounting portion is joined to a closure flap that operatively engages at least one sidewall to close the retainer pocket.

33. The retainer of claim 32, which further comprises mating elements of hook and loop fastener positions on the flap and at least one sidewall.

34. The retainer of claim 20, wherein the light source has one generally circular cross-section and the retainer pocket is rectilinear.

35. The retainer of claim 20, wherein the light source has one generally circular cross-section and the sidewalls forming the pocket are joined along an arcuate line.

36. The retainer of claim 20 that is secured to an article selected from a handbag, a purse, a make-up container, a backpack, a briefcase, a portfolio, clothing, luggage, a trunk and a storage locker.

37. The retainer of claim 20, wherein the light source further includes a second light switch that moves between on and off positions in response to the presence or absence of a magnetic field.

38. The retainer of claim 20, wherein the light source further includes a solid state programmable timer for controlling the duration of illumination of the LED, whereby power to the LED is interrupted after a predetermined period of illumination.

39. A compact, manually operable, programmable lighting device comprising:

a housing;

a circuit inside the housing that includes a manually actuatable switch, at least one LED, a portion of which projects from a wall of the housing, a power source positioned inside the housing, wherein the housing includes a removable power source cover, whereby access is provided to the interior of the housing and the power source;

a microprocessor and a timer; and whereby actuation of the manual switch from an off position to an on position initiates the timer for a predetermined timed lighting cycle and moving the manual switch to the off position during the lighting cycle interrupts power to the LED and resets the timer to an off condition.

40. The lighting device of claim 39, wherein a portion of the housing flexes to contact the manual switch and move the switch between the on and off positions.

41. The lighting device of claim 39 in which the circuit comprises a magnetically actuatable switch, whereby further the magnetic switch is movable between an off position and an on position in response to a magnetic field.

42. The lighting device of claim 41, wherein actuation of the manual switch while the magnetic switch is in the on position interrupts power to the LED.

43. The lighting device of claim 39, wherein the power source is at least one replaceable battery.

44. The lighting device of claim 39, wherein the removable cover further includes a conductive contact element that forms a portion of the circuit between the power source and the microprocessor.

45. The lighting device of claim 44, wherein the removable cover is rotatable with respect to the housing between a first locked position in which the contact element completes the circuit to the power source and a second unlocked position from which the cover is separable from the housing.

46. The lighting device of claim 39 which further comprises a lanyard extending from the housing.

47. The lighting device of claim 39, wherein the microprocessor and timer are part of a single integrated circuit device.

48. The lighting device of claim 39, wherein the housing is in the form of a disk having a circular cross-section.

49. The lighting device of claim 40, wherein the housing further includes a power source cover located on a portion of the housing opposite the manual switch.

50. The lighting device of claim 40, wherein the portion of the housing that flexes has a separate, generally circular periphery that is joined to the adjacent portion of the housing by a living hinge.

51. The lighting device of claim 39, wherein the housing is generally circular in cross-section and has a diameter of from about one inch to two inches and a thickness of about 0.5 inch.

52. The lighting device of claim 39, which further includes a general circular power source cover that attaches to and projects from one portion of the housing.

53. The lighting device of claim 39, wherein the manually actuatable switch is a push button switch.

* * * * *